United States Patent [19]

Shanahan et al.

[11] Patent Number: 4,755,786

[45] Date of Patent: Jul. 5, 1988

[54] THERMOSTAT

[75] Inventors: Eugene M. Shanahan, Hillsboro; Robert E. Smith, Wilsonville; Randal W. Koehler, Tigard, all of Oreg.

[73] Assignee: Eaton Corporation, Cleveland, Ohio

[21] Appl. No.: 29,920

[22] Filed: Mar. 25, 1987

[51] Int. Cl.[4] ..... H01H 37/12; H01H 37/36

[52] U.S. Cl. ..... 337/323; 337/319

[58] Field of Search ..... 337/320, 321, 323, 319, 337/318; 200/83 P, 83 S, 83 SA, 83 WM

[56] References Cited

U.S. PATENT DOCUMENTS 2,738,397 3/1956 Slonneger ..... 337/323

*Primary Examiner*—H. Broome

*Attorney, Agent, or Firm*—R. A. Johnston

[57] ABSTRACT

A thermostatic switch having a snap acting switch mounted for actuation between the side walls of a U-shaped bracket. A remote bulb-and-capillary thermal sensing capsule provides output motion to a lever for switch actuation. The lever has an edge portion pivotably engaging a reaction support tab on one bracket wall and a rotatable cam provides an adjustable reaction support on the opposite bracket wall. The cam slidably engages an arcuate groove on the lever to maintain the lever transversely and longitudinally positioned on the bracket for switch actuation.

28 Claims, 1 Drawing Sheet

THERMOSTAT

BACKGROUND OF THE INVENTION

The present invention relates to electrical switch assemblies of the type actuated by a thermally responsive or temperature sensor. Devices of this type are well known for use in controlling service cycling of electrical appliances, as for example, heating and air conditioning equipment and appliances and heaters employed in household use. One particular application of thermostats for heaters is the application of heaters for water-filled beds to provide individual sleeping comfort.

In applications for waterbed heaters, thermostats typically have employed a remote sensing bulb filled with liquid which is expansible through a capillary tube to a pressure capsule having an expansible diaphram. An intermediate lever is employed between the capsule diaphragm and the switching mechanism to provide the requisite amplification of diaphragm movement for effecting actuation of the switching mechanism for controlling the heating cycling.

In designing and manufacturing the aforesaid type of thermostats for waterbed heaters, problems have been encountered in positioning the intermediate lever between the capsule diaphragm and the switch actuator and providing the appropriate pivot or fulcrum for the lever and in providing for ease of calibration and range setting of the thermostat. Heretofore, the point of contact of the lever with the sensing capsule diaphragm has provided for the positioning of the lever member in the switch assembly by such expedients as a recess in the lever engaged by a raised portion of the diaphragm. However, in such arrangements, it has been found difficult to provide for accurate and repeatable set point adjustment operation of the thermostat in service due to wear of the adjustment mechanism or cam where the lever is pivoted and fixed at the point of contact with the diaphragm. Thus, it has been desired to find a way or means of positioning a switch actuating lever member in a thermostat in such a manner as to enable ease of manufacture, calibration and accurate repeatable adjustment of the actuation point within the range of desired temperatures.

BRIEF DESCRIPTION

The present invention provides a unique and novel thermostat construction which combines ease of manufacture and assembly with precision in calibration and ease of adjustment of the set point and repeatability in service of the set point. The present thermostat employs a generally U-shaped mounting bracket having a thermal sensing capsule anchored at the closed end thereof, with a snap acting switching mechanism mounted on the bracket adjacent the open ends of the U-shaped configuration. A movement amplifier lever is received within the walls of the U-shaped bracket and has a tab on one side pivotally engaging a corresponding tab on one wall of the bracket to provide a fixed reaction pivot support. An adjustable reaction pivot support is provided on the opposite wall of the bracket by a rotatable cam which slidably engages an arcuate groove formed in the lever adjacent the edge opposite the first reaction support. The reaction supports provide a fulcrum for the lever which is biased thereabout by a suitable spring for maintaining one end of the lever in contact with the temperature sensing capsule diaphragm which moves in response to expansion of fluid in the capsule. The opposite end of the lever has an adjustment screw which is calibrated for effecting actuation of the switching mechanism at the desired amount of lever movement. The arcuate groove in the lever slidably engages the adjustment cam in a manner effective to position and maintain the lever longitudinally and transversely within the bracket.

DETAILED DESCRIPTION

Figure 1:
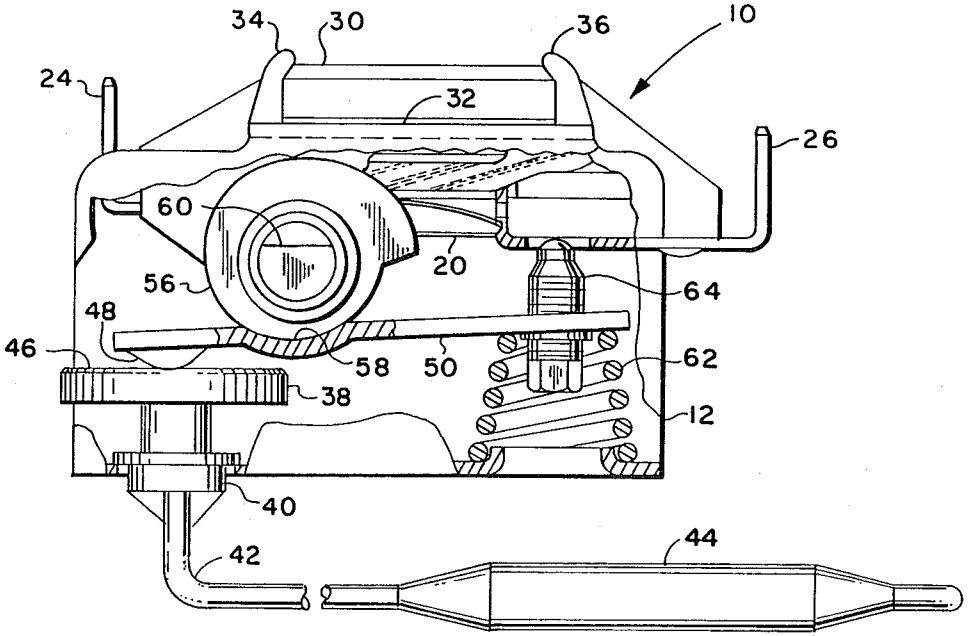
FIG 1 is a side elevation view of the thermostat assembly of the present invention with one wall of the mounting bracket broken away to expose the interior thereof; and, FIG. 2 is an end view taken from the left end of the assembly of FIG. 1.

Referring now to FIG. 1, the thermostatic switch assembly of the present invention indicated generally at 10 has a base in the form of a U-shaped mounting bracket 12, having a pair of oppositely disposed spaced parallel walls 14, 16. The upper portions of the U-shaped bracket have received between the walls 14, 16 a snap acting electric switch indicated generally at 18, which switch has an actuator member 20 operative on movement to effect making and breaking of a set of electrical contacts 17, 19.

Figure 2:
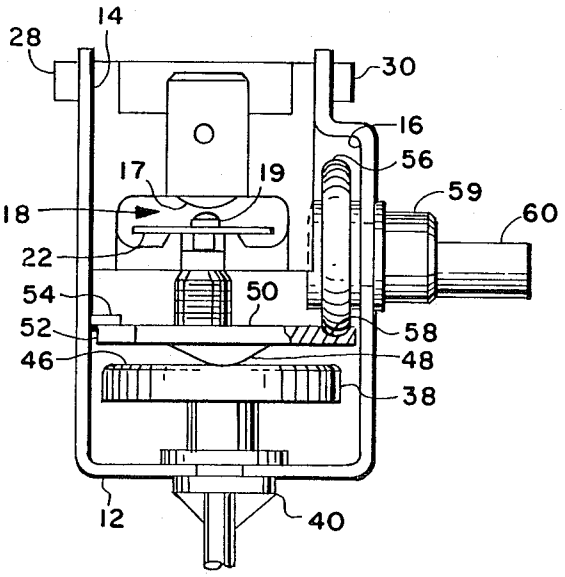

In the presently preferred practice of the invention, the switch 18 has a snap action; and, the blade member of the snap acting mechanism is shown partially in FIG. 2 and identified by reference numeral 22. Switch 18 has electrical terminals 24, 26 for electrical connection to an external circuit to be switched such as a heater for a waterbed or other electrical appliance. Switch 18 has oppositely disposed mounting lugs 28, 30, each of which is received on a registration surface such as the surface 32 shown in FIG. 1, and retained thereon by deformation of a pair of tabs, two of which are shown at 34, 36 in FIG. 1, and which are bent or deformed over the lug 30 to retain the switch on the bracket.

A thermal sensing means in the form of a fluid filled capsule 38 is anchored to the bottom portion or closed side of the U-shaped mounting bracket by a boss 40 received through an aperture in the bracket, and retained therein by any suitable expedient as for example, brazing, soldering or staking. The capsule has connected thereto one end of a capillary tube 42 with the opposite end of the capillary connected to a fluid filled sensing bulb 44 disposed remotely to sense a temperature condition for which it is desired to provide a control switching function in response to changes thereof. Upon the bulb 44 experiencing increase in the sensed temperature such that fluid in the bulb expands through the capillary 42 into the capsule 38 and causes expansion of the upper wall of the capsule which comprises a diaphragm 46. In operation, upon the fluid capsule 38 experiencing an increase in fluid pressure therein, the surface of diaphram 46 moves upward with respect to the body of the capsule 38.

A lever means 50 is received between the opposite walls of the bracket 12 and one edge thereof; shown as the lefthand edge and denoted 52 in FIG. 2, pivotally registering against a tab or lug 54 provided in the side 14 of bracket 12. The edge portion 52 of the lever and the lug 54 are disposed longitudinally intermediate the ends of the lever means 50 and one end of the lever 50 has a protuberance 48 which contacts the sensing capsule diaphragm.

A second pivot reaction support for the edge of lever 50, opposite the portion 52, is provided on the opposite wall 16 of the bracket 12 in the form of a rotatable cam 56 which has a shaft 59 extending through the wall 16 of the bracket; and, the shaft 59 has a flat 60 provided thereon adapted for receiving a suitable knob (not shown) thereover. The periphery of cam 56 is received in sliding registration with an arcuate slot 58 in sliding registration therein. The end of the lever 50 opposite the sensing capsule 38 has a suitable bias means in the form of a spring 62 having one end registering thereagainst and the other end registering against the bracket 12 as shown in FIG. 1. Under the urging of spring 62, the lever 50 is pivoted about the surface of cam 56 in the groove 58 and also about the tab 54 on the opposite side of the bracket from cam 56 and the opposite end of lever 50 is thus maintained in contact with the diaphragm 46.

A set screw 64 is threadedly received through the end of the lever contacted by spring 62 and the upper end of the set screw 64 serves as a contact surface for contacting the switch blade actuator 20 and effecting movement thereof. Set screw 64 is adjusted during calibration for switch actuation at the expected high and low temperatures to be experienced in service, and is also electrically isolated. The thermostat set point in service may be altered by rotating the cam 56 to causing lever 50 to pivot in a transverse direction about the diaphragm 46 and the tab 54 and thereby alter the preload of spring 62 on the lever and correspondingly change the set point for the actuation of the switch 18.

Although the invention has been illustrated in FIGS. 1 and 2 in the preferred practice wherein the groove 58 is an arcuate slot, it will be understood that the surface 58 of the lever 50 in contact with cam 56 may be configured for sliding engagement therebetween in other shapes than the arcuate slot illustrated in FIG. 1.

However, it will be understood that the configuration of the surface 58 and the cam 56, is intended to function for positioning and maintaining the lever 50 longitudinally and transversely in the proper location within the walls of the bracket 12. Thus, the present invention enables the sliding contact of the lever with the cam 56 to locate and position the lever longitudinally and transversely; and, the reaction support 54 provided on wall 14 of the mounting bracket need only serve as the pivoted reaction support in the vertical direction.

The present invention thus provides a unique and novel construction for a thermostatic switch assembly wherein the lever employed for amplifying motion of the thermal sensing means is fulcrummed and maintained in position by the adjustable reaction support surface provided for adjusting the set point of the switch.

Although the invention has been described hereinabove with respect to the illustrated embodiment, it will be understood that the invention is capable of variation and modification and is otherwise limited only by the scope of the following claims.

We claim:

1. A thermostatic switch assembly comprising:

(a) housing means defining a reaction support surface;

(b) thermal sensing means anchored to said housing means, and operative in response to changes in a sensed thermal condition to provide movement of an output member;

(c) electrical switching means anchored to said housing means and having an actuator member operable, upon movement, to effect actuation and de-actuation of said switching means;

(d) a lever having first portions along one margin thereof defining a pivot surface registering against said housing means reaction support for pivotal movement thereagainst; said lever having second portions thereof defining at least one registration surface thereon adapted for sliding contact therewith, said lever having third portions thereof contacting said switch actuator and fourth portions thereof contacting said output member;

(e) cam means mounted for selective movement on said housing means, said cam means slidably contacting said registration surface for providing a fulcrum, said cam means operative upon said contacting to maintain said lever longitudinally and transversely in position in pivotal contact with said base means reaction support and define a second reaction pivot support for said lever, said cam means further operative, upon said selected movement, to vary the position of said lever means second reaction support and the fulcrum of said lever for effecting changes in set point actuation of said switching means; and, (f) means biasing said lever means against said fulcrum.

2. The thermostatic switch assembly defined in claim 1, wherein said registration surface comprises a groove formed in said lever.

3. The thermostatic switch assembly defined in claim 1, wherein said registration surface comprises an arcuate groove formed in said lever, said groove operatively engaging said cam means for longitudinally positioning said lever on said housing means which permitting sliding pivotal movement of said lever thereabout.

4. The thermostatic switch assembly defined in claim 1, wherein said registration surfaces comprises a recess formed in said lever, said recess defining surfaces operatively engaging said cam means for longitudinally positioning said lever on said housing means while permitting sliding pivotal movement of said lever thereabout.

5. The thermostatic switch assembly defined in claim 1, wherein said fourth position of said lever means includes means defining an adjustable contact surface for varying the point of operation of said level for effecting switch actuation.

6. A thermostatic switch assembly comprising:

(a) base means defining a reaction support surface;

(b) switching means mounted on said base means and having an actuator member operable upon movement thereof to effect actuation and de-actuation of said switching means;

(c) temperature sensing means mounted on said base means and operative to provide movement of a driver member in response to changes in sensed temperature;

(d) lever means defining:

(i) a first portion disposed to pivotally contact said reaction support surface;

(ii) a second portion disposed for contacting said driver member for receiving movement input therefrom;

(iii) a third portion disposed for contacting said switch actuator member upon movement of said lever means by said driver member;

(iv) a fourth portion defining a fulcrum surface adapted to slidably contact an adjustable reaction support;

(e) cam means mounted for selective movement on said base means, said cam means contacting said fulcrum surface in sliding registration and operative to thereby provide a second reaction support for said lever means, said cam means operative upon said selective movement to vary the position of said fulcrum with respect to said base means, said cam means further operative by said sliding engagement to position and maintain said lever means such that said first portion pivots on said reaction support surface and said second portion contacts said driver member.

7. The switch assembly defined in claim 7, wherein said fourth portion of said lever means defines a fulcrum surface comprising a recess formed in said lever means.

8. The thermostatic switch assembly defined in claim 7, wherein said fourth portion of said lever means defines a fulcrum surface comprising a recess formed in said lever means; and, said cam means is rotatably mounted on said base means with the periphery of said cam means slidably received in said recess.

9. The thermostatic switch assembly defined in claim 7, wherein said fourth portion of said lever means defines a fulcrum surface comprising an arcuate groove formed in said lever means and said cam means include a rotatable member slidably registered in said groove.

10. The thermostatic switch assembly defined in claim 7, wherein said lever means third portion includes means for adjusting the point at which said lever means contacts said switch actuator.

11. The thermostatic switch assembly defined in claim 7, wherein said lever means is an elongated member having said first and fourth portions disposed longitudinally intermediate the ends thereof with said first portion disposed along one longitudinal margin and said fourth portion disposed adjacent the opposite longitudinal margin of said member.

12. A thermostatic switch assembly comprising:

(a) a generally U-shaped mounting bracket defining a first reaction pivot support on a side wall thereof;

(b) thermal sensing means anchored to the closed end of said U-shaped mounting bracket and having an output member movable in response to changes in a sensed temperature condition;

(c) switch means mounted on said bracket and having an output member operative upon movement to effect actuation and de-actuation of said switch means;

(d) cam means mounted on a second wall of said bracket, said cam means defining a second reaction pivot supporting surface and selectively movable on said bracket to provide adjustment of said second pivot surface, (e) a lever received between the side walls of said bracket, said lever having first portions intermediate the ends thereof contacting said first reaction pivot support for pivotal movement thereabout, said lever having second portions intermediate the ends thereof contacting said second reaction pivot surface, said second portions operative to maintain said lever located longitudinally and transversely on said bracket, said lever being disposed to pivot about said first pivot support and said second pivot supporting surface said lever having third portions thereof disposed to contact said sensor means output member and having fourth portions operative upon pivotal movement of said lever, to move said switch actuator member; and, (f) means biasing said lever third portion into contact with said sensor means output member.

13. The switch assembly defined in claim 12, wherein said cam means is rotatably mounted on said bracket and said second pivot supporting surface comprises arcuate surface on said cam means.

14. The switch assembly defined in claim 12, wherein said second portions of said lever means comprises the surfaces of a groove formed in the surface of said lever.

15. The switch assembly defined in claim 12, wherein said cam means is rotatably mounted on said bracket and said second pivot supporting surface comprises a curved peripheral surface; and, said lever means second portion comprises a pair of spaced parallel surfaces slidably engaging said curved peripheral surface.

16. The switch assembly defined in claim 12, wherein said cam means comprises an eccentric surface rotatably mounted on said bracket; and, said lever means second portions comprises a curved-bottom groove slidably engaging said eccentric surface of said cam means.

17. The switch assembly defined in claim 12, wherein said fourth portions of said lever means include adjustable means operative to define a contact surface for actuating said switch.

18. The switch assembly defined in claim 12, wherein said fourth portions of said lever means includes member threadedly received in said lever and operable to define an adjustable surface for contact said switch blade actuator.

19. A thermostatic switch assembly comprising:

(a) a mounting bracket having a pair of spaced wall portions;

(b) switching means mounted on said bracket and having an actuator member disposed between said walls operable upon movement to effect actuation and de-actuation, said bracket defining a fixed reaction support on one of said pair of walls and an adjustable reaction support on the other of said walls;

(c) temperature sensing means mounted to said bracket means, and operative in response to changes in a sensed temperature to provide movement of an output member;

(d) lever means disposed between said pair of walls and including means defining a first pivot surface contacting on said fixed reaction support and means defining a second pivot surface engaging said adjustable reaction support, said lever means being fulcrummed about said reaction supports and including means defining an input surface contacting said output member and means defining a driver surface, said second pivot surface being operative exclusively to maintain said lever means located longitudinally and transversely on said bracket means; and, (e) means biasing said lever means against said fixed and said adjustable reaction supports and said input surface against said sensing means output member, wherein movement of said sensing means overcomes said bias and moves said lever means about said fulcrum causing said driver surface to effect said movement of said switch actuator.

20. The switch assembly defined in claim 19, wherein said adjustable reaction support comprise a cam rotatably mounted on said bracket.

21. The switch assembly defined in claim 19, wherein said second pivot surface comprises a groove formed in said lever means.

22. The switch assembly defined in claim 19, wherein said adjustable reaction support comprises an eccentric cam rotatably mounted on said bracket and said second pivot surface comprises a groove slidably registering against said eccentric.

23. The switch assembly defined in claim 19, wherein said mounting bracket has a generally U-shaped configuration.

24. The switch assembly defined in claim 19, wherein said adjustable reaction support comprises a cam rotatably mounted to said bracket means; with said second pivot surface slidably engaging said cam.

25. The switch assembly defined in claim 19, wherein said adjustable reaction surface is slidably contacted by said second pivot surface.

26. The switch assembly defined in claim 19, wherein said means defining said driver surface includes an adjustable means.

27. The switch assembly defined in claim 19, wherein said means defining said driver surface includes an adjustment screw.

28. A thermostatic switch assembly comprising:

(a) a mounting bracket;

(b) switch means mounted on said bracket;

(c) thermally responsive means mounted on aid bracket and having an output member movable in response to changed in a sensed temperature condition;

(d) lever means received on said bracket disposed to pivot about a first fixed reation support on said bracket and second reaction support on said bracket spaced from said first support, said second support being operably adjustable to vary the unactuated position of said lever means, said lever means being maintained in position logitudinally and transversely on said bracket by said second support means and, (e) means biasing said lever means against said movable output member, wherein upon changes in said sensed temperature, said output member is operable to pivot said lever means about said first and second reaction support for actuating and deactuating said switch means.

* * * * *